US005772453A

United States Patent [19]

Tan et al.

[11] Patent Number: 5,772,453

[45] Date of Patent: Jun. 30, 1998

[54] SIDE-BY-SIDE DUAL PORT USB CONNECTOR

[75] Inventors: Haw-Chan Tan, Diamond Bar; Joel J. Yeh, San Gabriel, both of Calif.

[73] Assignee: Hon Hai Precision Ind. Co., Ltd., Taipei Hsien, Taiwan

[21] Appl. No.: 720,807

[22] Filed: Oct. 1, 1996

[51] Int. Cl.[6] ..... H01R 13/648

[52] U.S. Cl. ..... 439/79; 439/567

[58] Field of Search ..... 439/607, 55, 79, 439/217, 567

[56] References Cited

U.S. PATENT DOCUMENTS 4,818,239 4/1989 Erk ..... 439/55

5,468,154 11/1995 Yip et al. ..... 439/79

*Primary Examiner*—Gary F. Paumen

*Assistant Examiner*—Yong Ki Kim

[57] ABSTRACT

An arrangement for adoption of either the traditional UART D-Sub connector (70) or the upgrading USB connector (10) with a same mother board (100), includes a side-by-side dual-port USB connector assembly (10), which is generally integrally formed by two standard four-pin simplex type USB connector units (14), and the mother board (100), wherein the electrical and mechanical layout on the mother board (100) is arranged in some specific area not only for mounting the traditional D-Sub connector (70) but also the updated USB connector (10) thereon.

6 Claims, 6 Drawing Sheets

SIDE-BY-SIDE DUAL PORT USB CONNECTOR

BACKGROUND OF THE INVENTION

1. Field of The Invention

The invention relates to USB connectors, and particularly to an arrangement for upgrading the computer interface from UART to USB.

2. The Related Art

As known, currently the computer industry attempts to use a standard type USB (Universal Serial Bus) connector in place of all existing variant Input/output connectors under UART (Universal Asynchronous Receiver-Transmitter) configuration, such as D-Sub (D-shaped Subminiature) connectors, Mini Din connectors, Centronics connectors, etc., thereby reducing the manufacturing cost of the various connectors for different molding and processing, and simplifying the arrangement of the connectors on the mother board.

While, such transition from the traditional UART to the future USB takes time and is expected to last for a long time because too many parties are involved, including the mother boar manufacturers, the connector manufacturers, and the peripheries manufacturers. Thus, during this transition period, it is really required to have some arrangements in both the layout of the mother board and the configuration of the corresponding connector so that either the traditional UART D-Sub connector or the upgrading USB connector can be optionally mounted to the same mother board without making any changes or taking additional steps.

SUMMARY OF THE INVENTION

According to an aspect of the invention, an arrangement for adoption of either the traditional UART D-Sub connector or the upgrading USB connector with a same mother board, includes a side-by-side dual-port USB connector assembly, which is generally integrally formed by two standard four-pin simplex type USB connector units, and the mother board, wherein the electrical and mechanical layout on the mother board is arranged in some specific area not only for mounting the traditional D-Sub connector but also the updated USB connector thereon.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
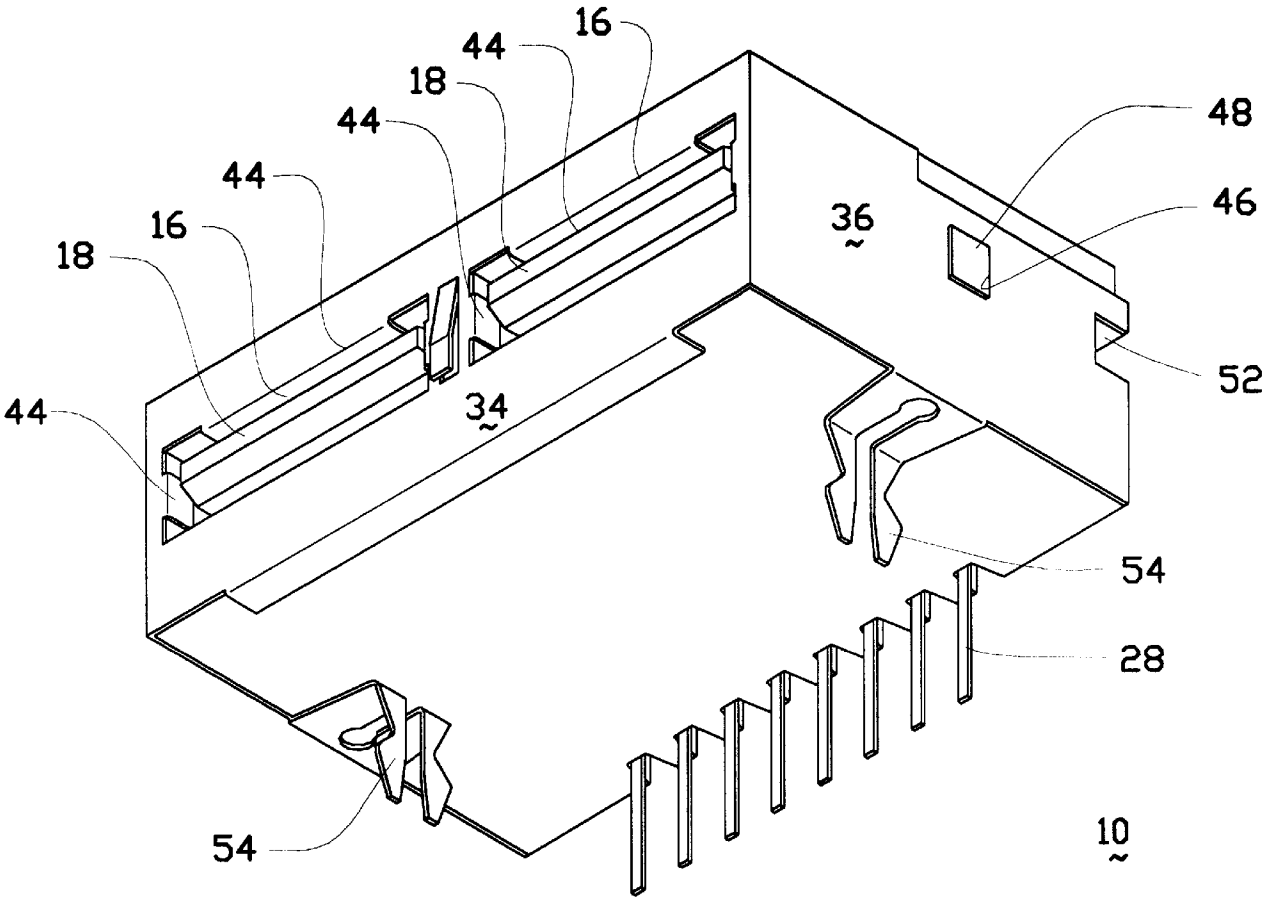
FIG. 1(A) is a front perspective view of a presently preferred embodiment of a side-by-side dual-port USB connector for use with a mother board, according to the invention.
FIG. 1(B) is a back perspective view of the side-by-side dual port USB connector of FIG. 1(A)>
Figure 1:
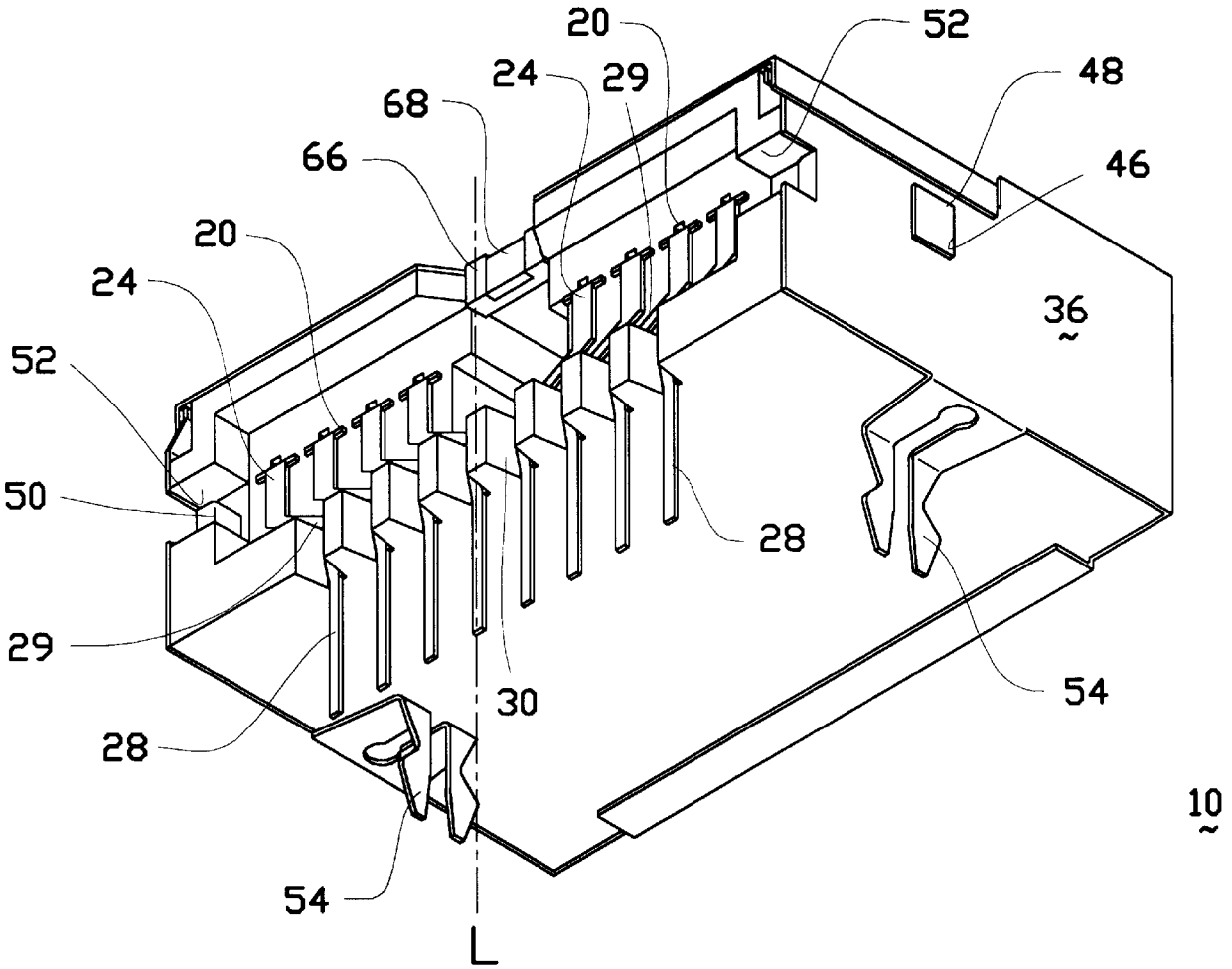
Figure 2:
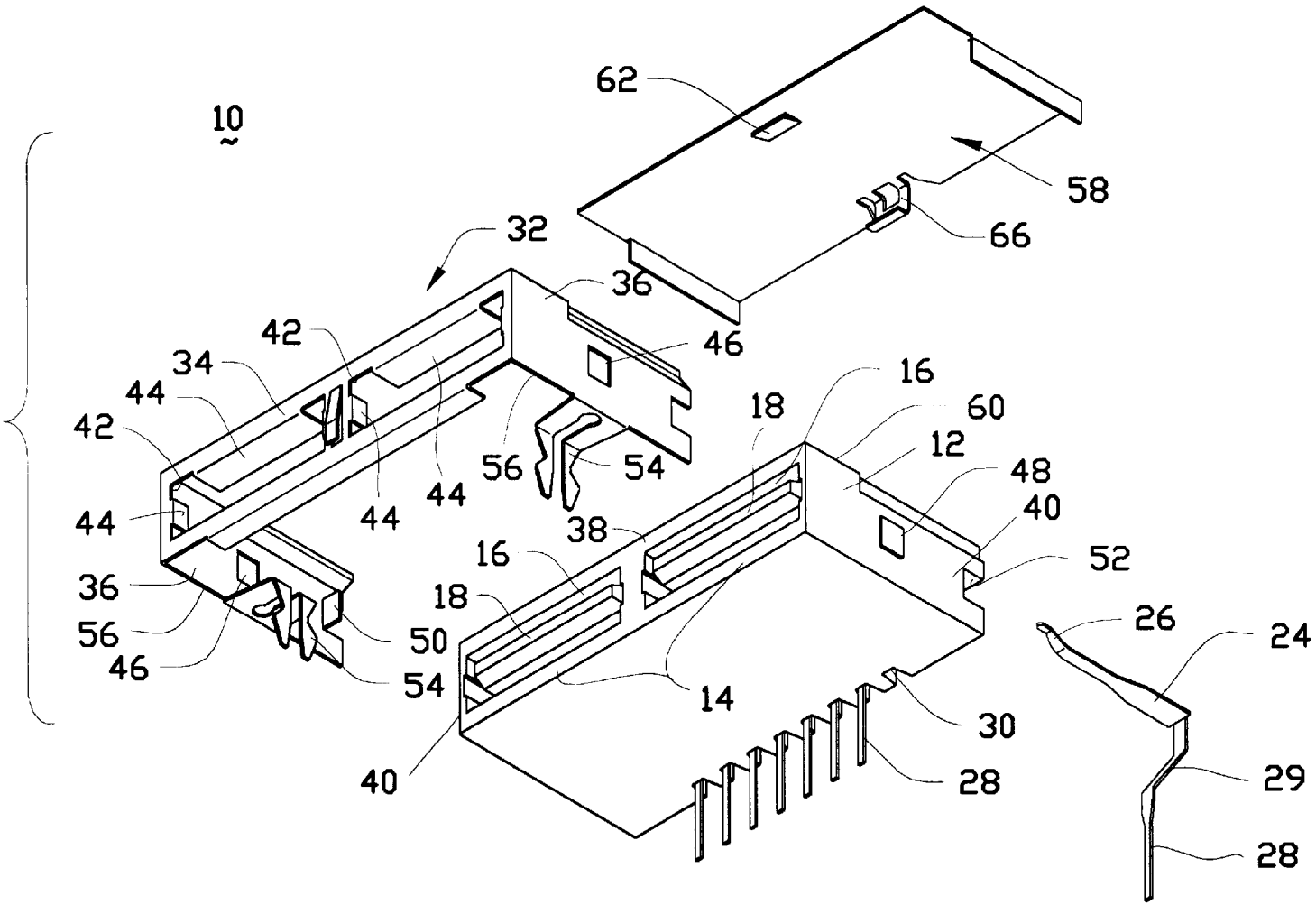
FIG. 2 is an exploded perspective view of the USB connector of FIG. 1.

It will be noted here that for a better understanding, most of like components are designated by like reference numerals throughout the various figures in the embodiments. Attention is directed to FIGS. 1(A), 1(B) and 2 wherein a side-by-side dual-port USB connector 10 includes an insulative housing 12 generally including two port units 14 integrally joined with each other. Each port unit 14 comprises an opening 16 with an plate 18 horizontally extending therein. Four passageways 20 extend through each port unit 14 and communicate with the opening 16. Correspondingly, four channels (not shown) are formed in the undersurface region of the plate 18. Four contacts 24 are respectively positioned within the unit 14 wherein each contact 24 includes a contact section 26 horizontally received within the corresponding one channel (not shown) and a tail section 28 vertically retained in the corresponding retaining slot 30 in the rear portion of the unit 14. It can be seen that each port unit 14 includes four retaining slots 30 so there are eight retaining slots 30 are, at equal intervals, on the rear portion of the housing 12 wherein the dimension of such interval is generally 0.1". The basic structure of the standard USB connector can be referred to the copending application having he same inventor and assignee, and Ser. No. 08/522,066 filed on AUG. 31, 1995.

A first shell 32 includes a front wall 34 and two side walls 36 for respectively covering the front surface 38 and two side surfaces 40 of the housing 12 wherein the front wall 34 comprises two apertures 42 each in alignment with the corresponding opening 16 of each port unit 14. Several tangs 44 inward extend from edges of the opening 16 for electrical and mechanical engagement with a complementary shielded plug type USB connector (not shown). Each side wall 36 of the first shell 32 has a retention hole 46 for latchable engagement with a protrusion 48 on the corresponding side surface 40 of the housing 12, and a locking hook 50 latchably received within a recess 52 in the rear portion of the housing 12. Each side wall 36 further includes a board-lock 54 extending downward adjacent a midpoint of the bottom edge 56 thereof, thereby forming a pair of board-locks 54 for the connector 10 for mounting on the mother board 100 (FIG. 4(A)).

A second shell 58 is attached to and the top surface 60 of the housing 12 for protectively covering the top surface 60 of the housing 12. The second shell 58 includes a backward projecting tag 62 for being retainably engaged within an indent (not shown) on the top surface 60, and a latching hook 66 for locking reception within a recession 68 in the rear portion of the housing 12.

Figure 4:
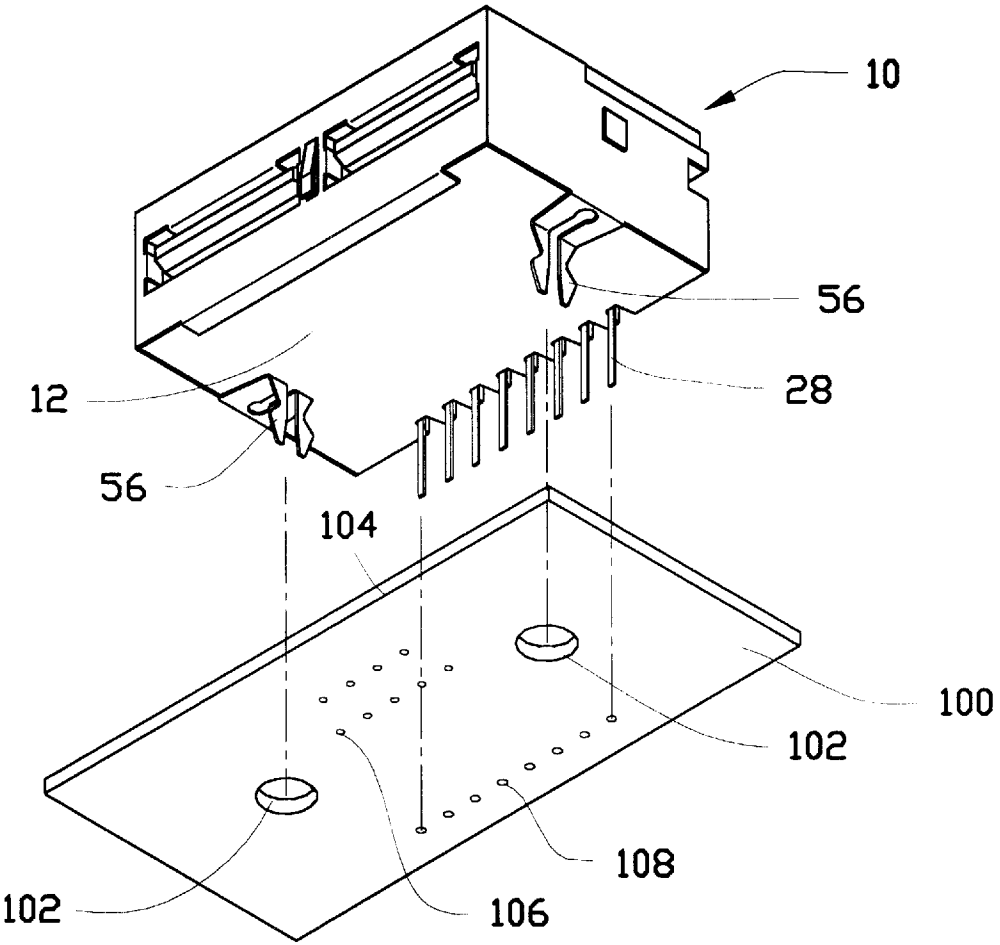
FIG. 4(A) is a perspective view of the USB connector of FIG. 1 with a mother board on which the USB is adapted to be mounted.
FIG. 4(B) is a perspective view of the D-Sub connector of FIG. 3 with the mother board of FIG. 4(A) on which the D-Sub is adapted to be mounted.
Figure 4:
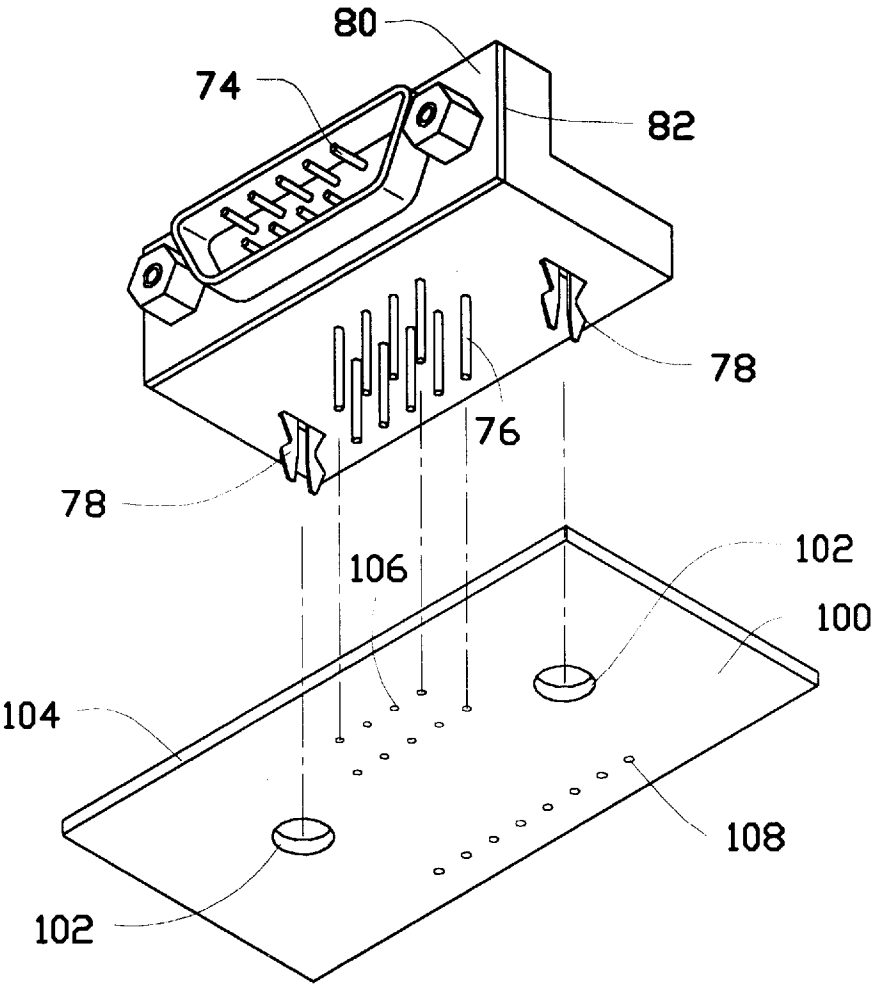

Therefore, the first shell 32 cooperates with the second shell 58 to commonly shield the front surface 38, two side surfaces 40 and the top surface 60 of the housing 12, except that the rear surface and the bottom surface of the housing 12 are exposed for allowing the contact tail sections 28 to extending to an exterior for soldering on the mother board 100 (FIG. 4(A)).

Figure 3:
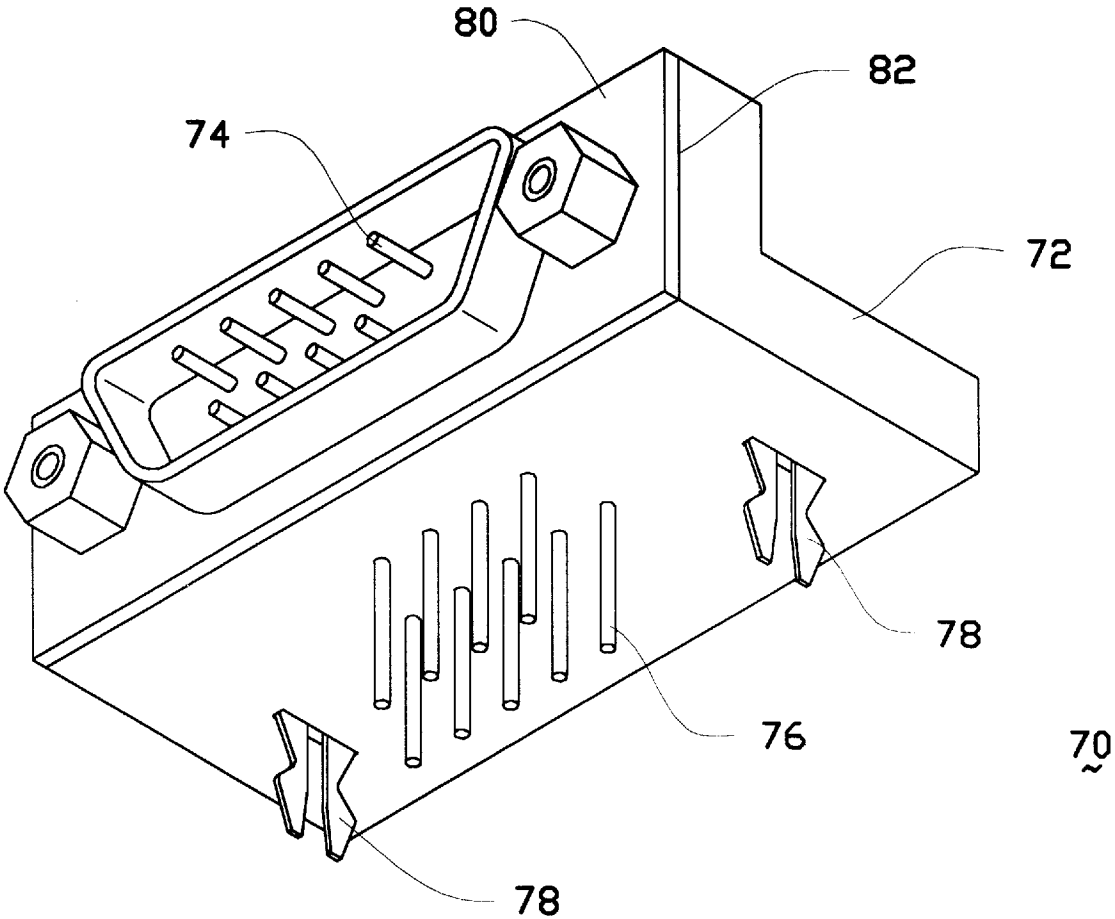
FIG. 3 is a perspective view of a traditional nine-pin D-Sub connector.

FIG. 3 shows a standard traditional nine-pin D-Sub connector 70 which includes a insulative housing 72 enclosing therein nine contacts 74 wherein the contact tails 76 of the contacts 74 are arranged in two rows for extending through the corresponding holes 106 in the mother board 100 (FIG. 4(B)). A pair of boardlocks 78 are attached to the housing 72 for cooperation with the mother board 100 (FIG. 4(B)). A shell 80 is positioned on the front surface 82 of the housing 72.

FIG. 4(A) and FIG. 4(B) respectively show a same mother board 100 respectively incorporating the side-by-side dual-port USB connector 10 and the D-Sub connector 70. Such mother board 100 includes a pair of boardlock retaining holes 102 spaced to an front edge 104 of the mother board 100 in a first distance. Two rows of contact tail holes 106 are generally disposed on a region between such pair of boardlock retaining holes 102 for receiving the corresponding two rows of contact tails 76 of the D-Sub connector 70. The mother board 100 further includes another one row of contact tail section holes 108, which is spaced to the front edge 104 of the mother board 100 in a second distance much larger than the first distance, for receivable engagement with the contact tail sections 28 of the USB connector 10.

It can be noted that the boardlock retaining holes 102 in the mother board 100 are designedly adapted to receive either the boardlocks 56 of the USB connector 10 or the boardlocks 78 of the D-Sub connector 70. Under this condition, the contact tails 76 of the D-Sub connector 70 extend downward in alignment with the corresponding two rows of the contact tail holes 106 and can be properly received therein when the D-Sub connector 70 is mounted on the mother board 100; otherwise, the contact tail sections 28 of the USB connector 10 extend downward in alignment with the corresponding one row of the contact tail section holes 108 and can be properly received therein when the USB connector 10 is mounted on the mother board 100. Apparently, because the D-Sub connector 70 and the USB connector 10 generally share the same region on the mother board 100, the D-Sub connector 70 and the USB connector 10 are mutually excluded from each other when they cooperate with the mother board 100.

It is contemplated that the circuits on the mother board 100 should be arranged to have the one corresponding set communicating between the contact tale holes 106 and the conventional UART processing circuits, and have another corresponding set communicating between the contact tail section holes 108 and the upgraded USB processing circuits for respective and mutually exclusive cooperation with the D-Sub connector 70 or the USB connector 10 according to which type connector being mounted on the mother board 100.

It is understood that in comparison with the D-Sub connector 70, the side-by-side dual-port USB connector 10 has be larger dimension in a front-to-end direction so that the contact tail sections 28 of the contacts 24 of the USB connector 10 can reach and be in alignment with the farther single row of holes 108 in the mother board 100 while the contact tails 76 of the contacts 74 of the D-Sub connector 70 only can reach and be in alignment with the closer two rows of holes 106 in the mother board 100.

The object of the invention is mainly to provide options and flexibility for computer manufacturer who buys or makes mother board and buys connectors from the vender. Via the arrangement of the invention, such computer manufacturer can selectively use the traditional D-sub connector or the updated USB connector for implementing his different rank models for meeting his different level customer's requirements. The invention results from this intention so that one additional row of contact tail section holes is provided on the farther region of the mother board. Moreover, a side-by-side dual-port USB connector which owns the standard interface configurations as simplex type USB has, is created to purposely comply with the lateral dimension of the conventional nine-pin D-Sub connector, so that such pair of boardlocks 54 of the side-by-side dual-port USB connector 10 may use the same boardlock retaining holes 102 with those of the D-Sub connector 70. Also, as mentioned earlier, the front-to-end dimension of the side-by-side dual-port USB connector 10 is intentionally extended larger than the original simplex type or stacked type USB connector assembly as shown in the copending application Ser. No. 08/522,066 filed Aug. 31, 1995 with the same inventor and assignee. This extended front-to-end dimension extension is to have the contact tail sections 28 of the USB connector 10 mate with the farther row of holes 108 and will not interfere with the closer rows of holes 106 which are for the D-Sub connector 10. In conclusion, the features of the invention include the structure of the side-by-side connector 10 itself, the mother board layout arrangement, and further include the relationship among the conventional D-Sub connector 70, the updated USB connector 10, and the new version mother board 100, as shown in this application.

Another feature of the invention includes the contact tail section 28 of each contact 24 of one unit 14 having an offset section 29 so that the end portion of the contact tail section 28 can inward moved closer to the centerline L of the housing 12. Similarly, the other four contacts 24 of the other unit 14 also owns the same characters, whereby the right side contact tails sections 28 of one unit 14 are generally mirror images of those of another unit on the left side. This arrangement is to comply with the single row of holes 108, in the mother board 100, which have the equal intervals between every two holes 108.

The invention also provides an advantage of increasing the interface number from "one" nine-pin conventional D-Sub connector 70 to "two" updated USB connector units 14. This will upgrade the capability of the computer's processing.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An arrangement for optionally utilizing an updated USB connector assembly or a traditional D-Sub connector on a mother board, comprising:

said mother board including a first set of plural contact holes positioned in a first distance from an edge of the mother board, and a second set of plural contact holes positioned in a second distance from the edge of the mother board wherein the second distance is substantially larger than the first distance;

pair of boardlock retaining holes disposed adjacent two sides of the first set of contact holes;

said USB connector assembly including a pair of boardlocks adapted to be received within the boardlock retaining holes, respectively, and a plurality of first contacts wherein contact tail sections of said first contacts extend downward in alignment with the corresponding contact holes of the second set, respectively; and said D-Sub connector including a pair of boardlocks also adapted to be received within the boardlock retaining holes, respectively, and a plurality of second contacts wherein contact tails of said second contacts extend downward in alignment with the corresponding contact holes of the first set, respectively, so that said USB connector assembly and said D-Sub connector can be mutually exclusively mounted on the mother board for different rank models usage.

2. The arrangement as defined in claim 1, wherein a lateral dimension of said USB connector assembly is somewhat equal to that of the D-Sub connector while a front-to-end dimension of said connector USB connector assembly is substantially larger than that of the D-Sub connector.

3. The arrangement as defined in claim 2, wherein said D-Sub connector is in a form of two rows of nine-pin type, and said USB connector assembly is substantially of a side-by-side dual-port type and is generally formed by two units integrally joined with each other.

4. A method for having two different connectors exclusively used with one PC board, the steps comprising:

providing said PC board with first retaining means in a connector-mounting area adjacent to an edge;

providing a first set of contact circuits in a first region of said connector-mounting area and providing a second set of contact circuits in a second region of said connector-mounting area;

providing a first connector having second retaining means being adapted to cooperate with said first retaining means in the PC board for retaining the first connector on the PC board, and arranging a plurality of first contacts of the first connector adapted to be mechanically and electrically connected to said first set of contact circuits on the PC board; and providing a second connector having third retaining means being adapted to cooperate with the same first retaining means in the PC board for retaining the second connector on the PC board, and arranging a plurality of second contacts of the second connector adapted to be mechanically and electrically connected to said second set of contact circuits on the PC board; whereby said first connector and said second connector can be mutually exclusively or interchangeably mounted on the same connector-mounting area of the PC board and operated with the corresponding circuits.

5. The method as defined in claim 4, wherein one interface port is provided with the first connector and two interface ports are provided with the second connector.

6. The method as defined in claim 4, wherein the first set of contact circuits is close to the first retaining means but the second set of contact circuits is far from the first retaining means.

* * * * *